US006262699B1

(12) United States Patent
Suzuki et al.

(10) Patent No.: US 6,262,699 B1
(45) Date of Patent: Jul. 17, 2001

(54) METHOD OF DRIVING PLASMA DISPLAY PANEL

(75) Inventors: Masahiro Suzuki; Tsutomu Tokunaga, both of Yamanashi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/119,658

(22) Filed: Jul. 21, 1998

(30) Foreign Application Priority Data

Jul. 22, 1997 (JP) ..... 9-195725
Jun. 4, 1998 (JP) ..... 10-156267

(51) Int. Cl.[7] ..... G09G 3/28
(52) U.S. Cl. ..... 345/68; 345/60; 345/63
(58) Field of Search ..... 315/169.4; 345/60, 345/67, 148, 63, 68

(56) References Cited

U.S. PATENT DOCUMENTS 5,317,334 * 5/1994 Sano ..... 345/148
5,446,344 * 8/1995 Kanazawa ..... 315/169.4
5,790,087 * 8/1998 Shigeta et al. ..... 345/67
5,943,031 * 8/1999 Tokunaga et al. ..... 345/60
5,982,344 * 11/1999 Tokunaga ..... 345/67
5,995,069 * 11/1999 Tokunaga et al. ..... 345/60

* cited by examiner

*Primary Examiner*—Steven Saras
*Assistant Examiner*—Srilakshmi Kumar
(74) *Attorney, Agent, or Firm*—Morgan, Lewis & Bockius LLP

(57) ABSTRACT

A method of driving a plasma display panel reduces an address write cycle and also realizing a stable high definition, high-quality display without erroneous discharge. In the light emission by driving the plasma display panel having plural pairs of row electrodes and plural column electrodes arranged so as to cross these pairs of row electrodes and forming discharge cells at intersections of the pairs of row electrodes and the column electrodes, ones of the pairs of row electrodes are divided into first and second row electrode groups, and a scan pulse is applied to one row electrode of the second row electrode group just after applying the scan pulse to one row electrode of the first row electrode group.

17 Claims, 13 Drawing Sheets

S1a

S2a

S11a

S12a
ON
OFF
80A

VAH
V1
V2
V3
0

VAL

ROW ELECTRODE Y1
PP
FP
SP
BP
VA
VB

S1b

S2b

S11b

S12b
80B

VBH

VBL

ROW ELECTRODE Yk+1

COLUMN ELECTRODES D1~Dm
DP1
DPk+1

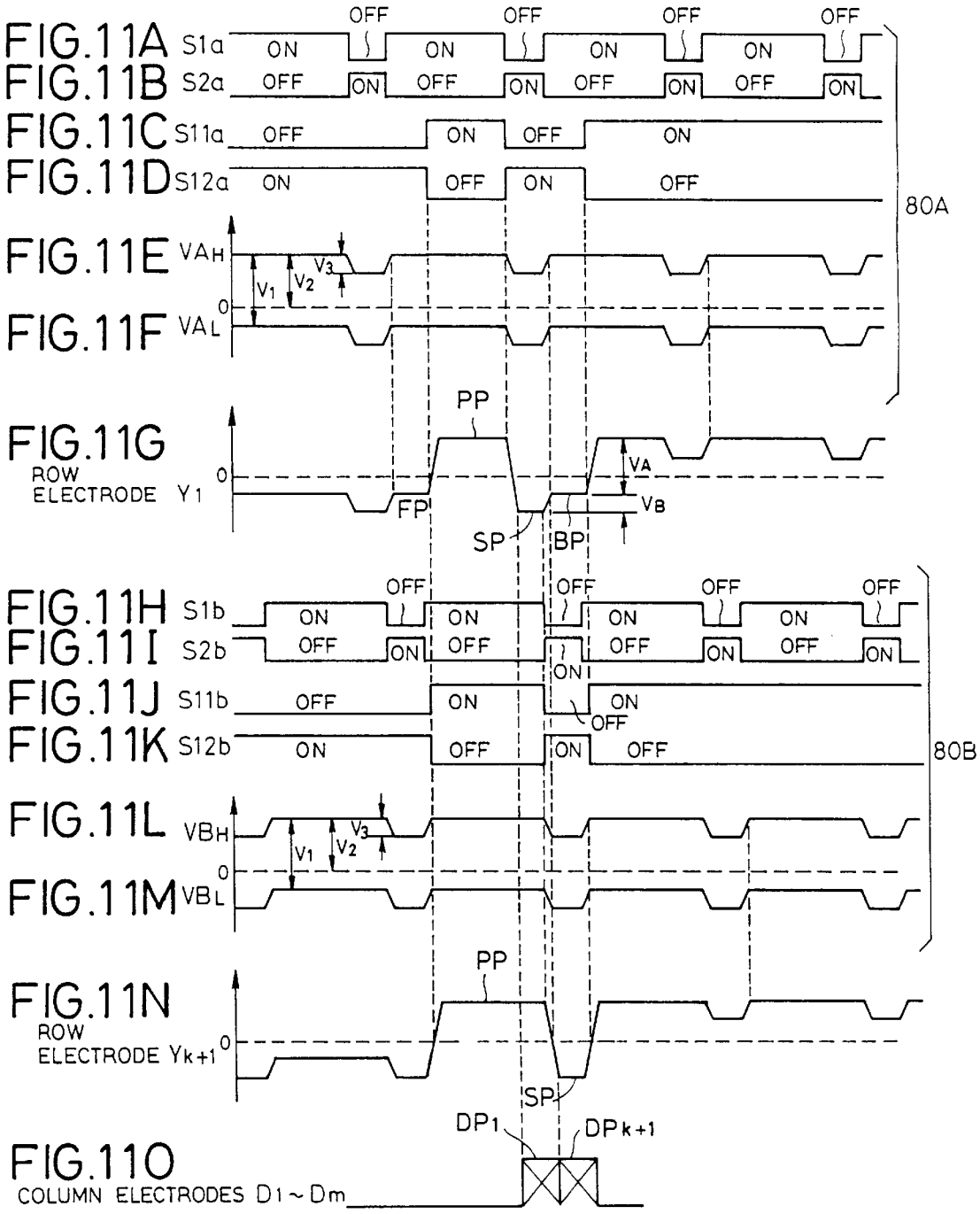
FIG.11A S1a
FIG.11B S2a
FIG.11C S11a
FIG.11D S12a
FIG.11E VAH
FIG.11F VAL
FIG.11G ROW ELECTRODE Y1
FIG.11H S1b
FIG.11I S2b
FIG.11J S11b
FIG.11K S12b
FIG.11L VBH
FIG.11M VBL
FIG.11N ROW ELECTRODE Yk+1
FIG.11O COLUMN ELECTRODES D1~Dm
ON
OFF
80A
80B
PP
FP
SP
BP
VA
VB
V1
V2
V3
0
DP1
DPk+1

S1
ON
OFF
ON
OFF
ON
OFF

S2
OFF
ON
OFF
ON
OFF
ON

VH
V3
V2
V1
0

VL

S11a
OFF
ON
OFF
ON

S12a
ON
OFF
ON
OFF
80A

S13a
ON
OFF
ON
OFF
ON
OFF

ROW ELECTRODE Y1
0
V3
FP
PP
BP
SP

S11b
OFF
ON
OFF
ON

S12b
ON
OFF
ON
OFF
80B

S13b
ON
OFF
ON
OFF
ON
OFF

ROW ELECTRODE Yk+1
0
PP
SP
DP1
DPk+1

COLUMN ELECTRODES D1 ~ Dm

METHOD OF DRIVING PLASMA DISPLAY PANEL

BACKGROUND OF THE INVENTION

1. Field of the Invention

The present invention relates to a method of driving a matrix display type plasma display panel (hereinafter referred to as PDP).

2. Description of Related Art

As well known, PDP has been variously studied as a thin planar display device. A matrix display type PDP is known as one of the PDPs.

As one of methods of displaying an image with gradation on this matrix display type PDP, known is a so-called subfield method in which the image is displayed by dividing one field of display period into N subfields to be lighted for a period of time corresponding to weighted bit positions of N-bit pixel data.

This subfield method comprises the steps of: simultaneous reset for once initializing all of discharge cells; address writing for setting lighting discharge cells and un-lighting discharge cells by scanning an address (writing the data) in accordance with image data; and sustain discharge for holding the lighting discharge cells and un-lighting discharge cells discharged by the application of a sustain pulse.

At this time, a cycle of the address write must be shortened in order to realize a highly fine display by increasing the number of lines and increasing the number of display gradation in such a PDP.

For example, when the image is displayed at VGA resolution of 640×480 dots, 4–5 [$\mu$SEC] are satisfactory for a scan rate. However, the higher-speed write, for example, a write period of about 2 [$\mu$SEC] is required to display the image at XGA resolution of 1024×768 dots.

FIG. 1 shows a configuration of a plasma display device for carrying out such a high-speed address write.

In PDP 10 shown in FIG. 1, formed are row electrodes $Y_1$–$Y_4$ and row electrodes $X_1$–$X_4$ which make pairs of row electrodes so that a pair of X and Y may correspond to each of rows (the first to fourth rows) on one screen. Furthermore, formed are column electrodes $D_1$–$D_4$ which make column electrodes so that they may be perpendicular to these pairs of row electrodes, a dielectric layer and a discharge space (not shown) may be placed therebetween and they may each correspond to each of columns (the first to fourth columns) on one screen. At this time, one discharge cell is formed at an intersection of a pair of row electrodes (X, Y) and one column electrode D.

An address driver 20 converts one screen of pixel data in the PDP 10 into pixel data pulses corresponding to these pixel data on a row-by-row basis. These pulses are applied to each of the address electrodes $D_1$–$D_4$ in an order as shown in FIGS. 2A–2G:

a pixel data pulse group $DP_1$ corresponding to the first row;

a pixel data pulse group $DP_3$ corresponding to the third row;

a pixel data pulse group $DP_2$ corresponding to the second row; and a pixel data pulse group $DP_4$ corresponding to the fourth row.

Here, an X-row electrode driver 30 first applies a reset pulse $RP_X$ as shown in FIG. 2B to the row electrodes $X_1$–$X_4$.

A Y-row electrode driver 40A is used for applying various driving pulses as described below to a block of the row electrodes Y in the upper half of one screen in the PDP 10,that is, the row electrodes $Y_1$ and $Y_2$. On the other hand, a Y-row electrode driver 40B is used for applying various driving pulses as described below to a block of the row electrodes Y in the lower half of one screen in the PDP 10, that is, the row electrodes $Y_3$ and $Y_4$.

In FIGS. 2C through 2F, at the same time when the reset pulse $RP_X$ is applied to the row electrodes, the Y-row electrode driver 40A applies a reset pulse $RP_Y$ as shown in FIGS. 2C and 2D to the row electrodes $Y_1$ and $Y_2$. Moreover, at the same time when the reset pulse $RP_X$ is applied to the row electrodes, the Y-row electrode driver 40B applies a reset pulse $RP_Y$ as shown in FIGS. 2E and 2F to the row electrodes $Y_3$ and $Y_4$ (a reset step).

This application of the reset pulse causes all the discharge cells in the PDP 10 to be discharged/excited, so that charged particles are generated. After the termination of this discharge, a predetermined amount of wall charges are uniformly formed on the dielectric layers in all the discharge cells.

Next, immediately after applying a positive-voltage priming pulse as shown in FIG. 2C to the row electrode $Y_1$, the Y-row electrode driver 40A applies a negative-voltage scan pulse SP to the row electrode $Y_1$. At this time, immediately after applying the positive-voltage priming pulse to the row electrode $Y_3$ at a timing as shown in FIG. 2E, the Y-row electrode driver 40B applies the negative-voltage scan pulse SP to the row electrode $Y_3$. Furthermore, immediately after applying the positive-voltage priming pulse to the row electrode $Y_2$ at a timing as shown in FIG. 2D, the Y-row electrode driver 40A applies the negative-voltage scan pulse SP to the row electrode $Y_2$.

Furthermore, immediately after applying the positive-voltage priming pulse to the row electrode $Y_4$ at a timing as shown in FIG. 2F, the Y-row electrode driver 40B applies the negative-voltage scan pulse SP to the row electrode $Y_4$ (an address step).

At this time, out of the same cells existing in the row electrodes to which the scan pulse SP has been applied, the discharge occurs in the discharge cells to which the high-voltage pixel data pulse DP has been applied, most of the wall charges are thus lost. On the other hand, since no discharge occurs in the discharge cells to which the low-voltage pixel data pulse DP has been applied, the wall charges remain. That is, executed is a so-called pixel data write in which whether or not the wall charges remain in the discharge cells is determined depending on the pixel data pulse DP applied to the column electrode.

A priming pulse PP is applied to the electrode immediately before the application of the scan pulse, whereby the charged particles, that have been obtained in the above-described reset step and reduced as time has passed, are reformed in the discharge space in the PDP.

Therefore, under the same conditions in which these charged particles are present on any one of the first to fourth rows, the pixel data write by the application of the scan pulse SP is carried out.

Next, the X-row electrode driver 30 incessantly applies a positive-voltage sustain pulse $IP_X$ to the row electrodes $X_1$–$X_4$. The Y-row electrode drivers 40A and 40B incessantly apply a positive-voltage sustain pulse $IP_Y$ to the row electrodes $Y_1$–$Y_4$ at a timing shifted from the timing of the application of the sustain pulse $IP_X$ (a sustain discharge step).

Over the time period for which the sustain pulses $IP_X$ and $IP_Y$ are alternately applied to the row electrodes, the discharge cells in which the above-mentioned wall charges remain are repeatedly discharged and emit a light, and the discharge cells keep emitting the light.

As described above, in such a driving method, an attempt is made to reduce an address write cycle by overlapping the timing of the application of the priming pulse PP with the timing of the application of the scan pulse SP to other row electrodes.

For example, when a write scan (addressing) is performed for the row electrode $Y_1$ on the first row, the negative-polarity scan pulse SP applied to this row electrode $Y_1$, the positive-polarity pixel data pulse $DP_1$ applied to the column electrodes $D_1$–$D_4$ and the positive-polarity priming pulse PP applied to the row electrode $Y_3$ on the third row of a second row electrode group (the row electrodes $Y_{3\ and\ Y4}$) are applied to the electrodes at an overlapping timing.

However, when the timings of the application of the pixel data pulse $DP_1$ and the priming pulse PP are thus overlapped with each other, the negative wall charges are stored in the column electrodes $D_1$–$D_4$ during a priming discharge by the priming pulse PP applied to the above-described row electrode $Y_3$.

Therefore, in the write scan on the third row following this priming discharge, the negative-polarity scan pulse SP is applied to the row electrode $Y_3$, whereby, during attempting to generate a selective erasure discharge responding to the positive-polarity pixel data pulse $DP_3$, the selective erasure discharge is difficult to generate by an influence of the negative wall charges on the column electrodes $D_1$–$D_4$ stored due to the just previous priming discharge, which makes a stable display operation difficult.

Moreover, when the waveform of each driving pulse to be applied to the aforementioned first row electrode group is caused to differ from the waveform of each driving pulse to be applied to the second row electrode group, the Y-row electrode drivers 40A and 40B become also disadvantageously unbalanced at the address margins thereof.

OBJECT AND SUMMARY OF THE INVENTION

The present invention is made in order to solve problems as described above. It is an object of the present invention to provide a method of driving a plasma display panel which can reduce an address write cycle and also realize a stable highly-fine/high-quality display without erroneous discharge.

According to the present invention, there is provided a method of driving a plasma display panel which has a plurality of pairs of row electrodes and a plurality of column electrodes, the plurality of column electrodes being arranged so as to cross the pairs of row electrodes and forming discharge cells at intersections of the pairs of row electrodes and the column electrodes, the method performing when driving the plasma display panel to emit light, an operation of dividing one field of display period is into a plurality of subfields, each subfield being composed of an address period and a sustain discharge period so as to display an image, the address period in which, immediately after applying a priming pulse of a predetermined polarity to one of the pair of row electrodes, a scan pulse of an opposite polarity to the polarity of the priming pulse is applied to said row electrode and simultaneously a pixel data pulse is applied to the column electrode whereby lighting discharge cells and un-lighting discharge cells are set in response to said pixel data pulse, the sustain discharge period for holding said lighting discharge cells and the un-lighting discharge cells discharged by applying a sustain pulse to the pair of row electrodes, wherein ones of the pairs of row electrodes are divided into first and second row electrode groups, and the scan pulse is applied to one row electrode of the second row electrode group immediately after applying the scan pulse to one row electrode of the first row electrode group.

BRIEF DESCRIPTION OF THE DRAWINGS

For a more complete understanding of the present invention and the advantages thereof, reference is now made to the following description taken in conjunction with the accompanying drawings, in which;

FIGS. 11A–11O show another example of the operating waveforms generated by the plasma display device shown in FIG. 9;

DETAILED DESCRIPTION OF THE PREFERRED EMBODIMENTS

Figure 1:
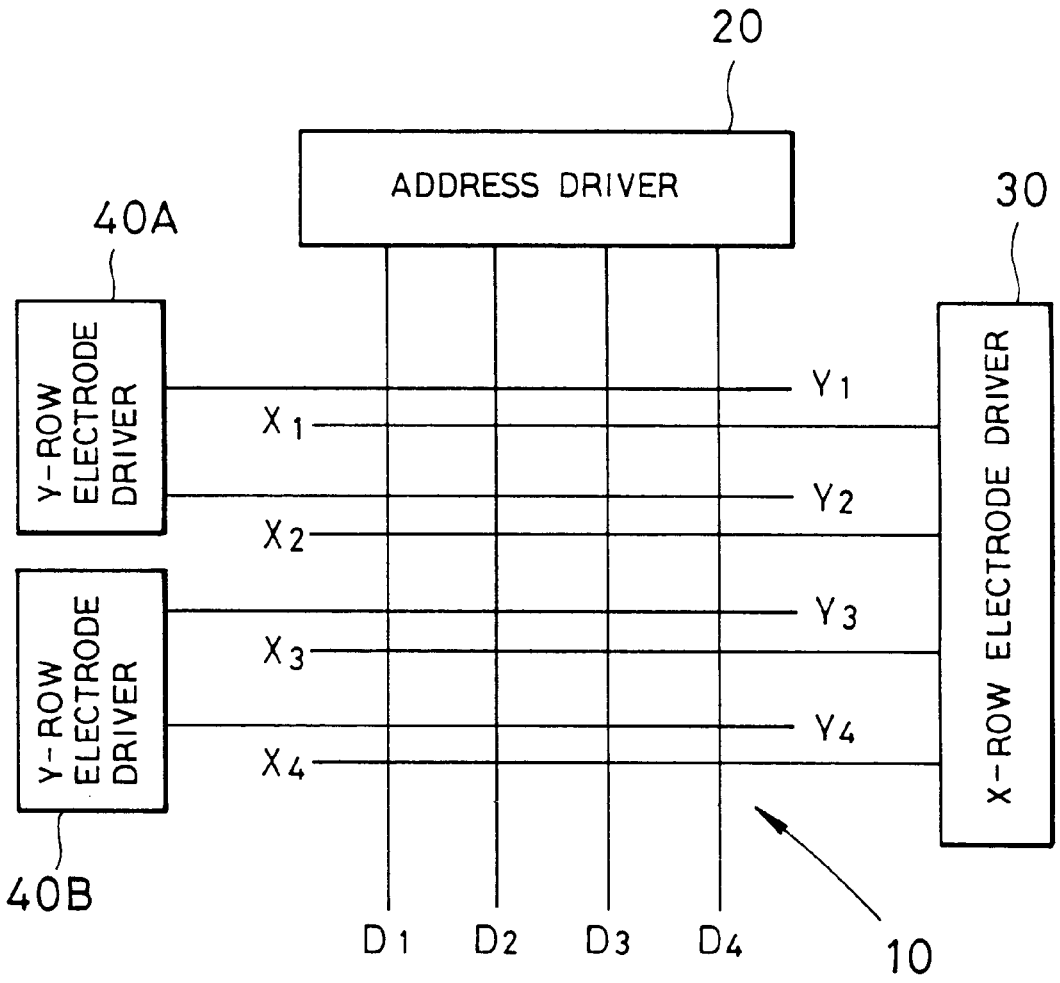
FIG. 1 is a diagram schematically showing the structure of a plasma display device.
Figures 2A, 2B, 2C, 2D, 2E, 2F, 2G:
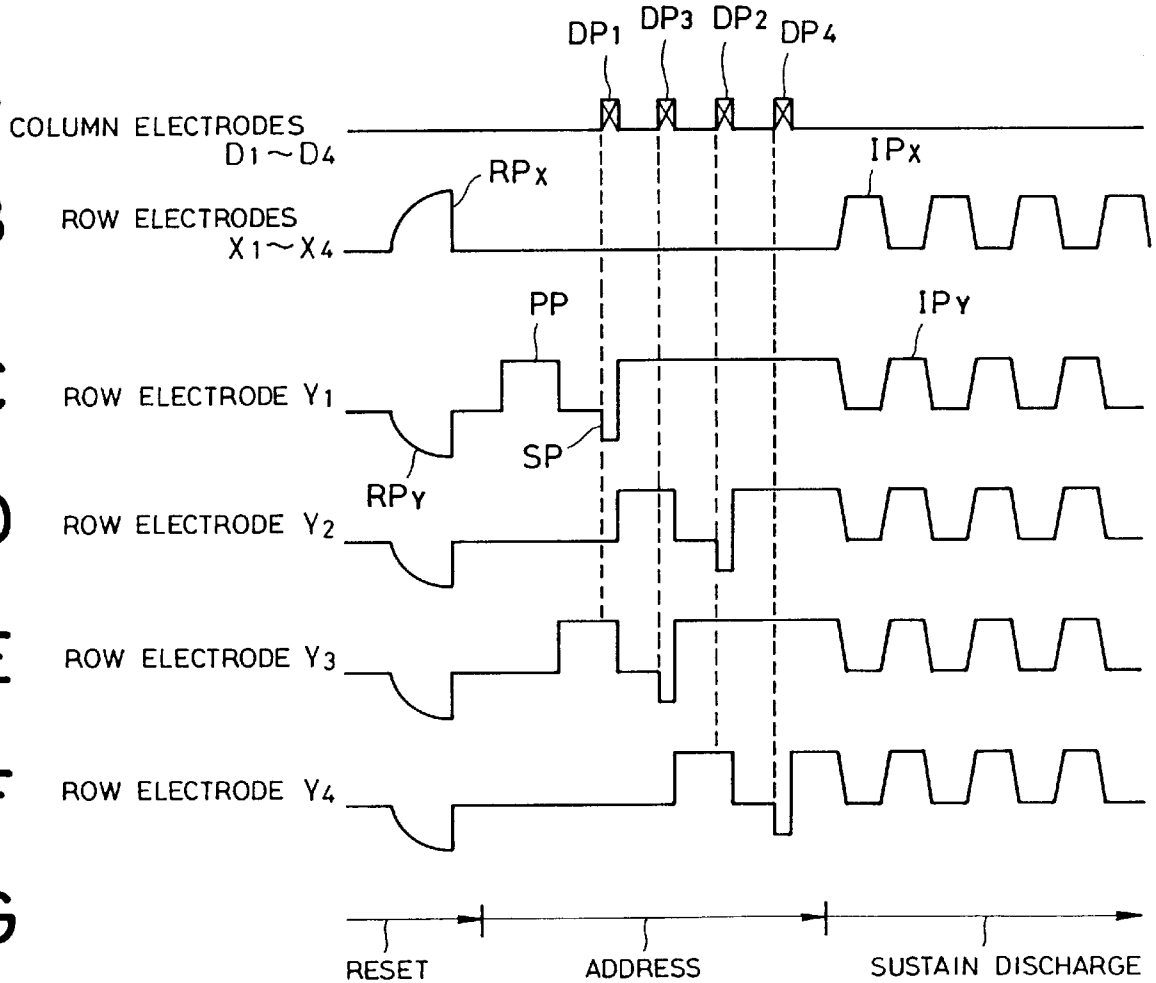
FIGS. 2A–2G are timing charts of the application of various driving pulses by drivers of FIG. 1.
Figure 3:
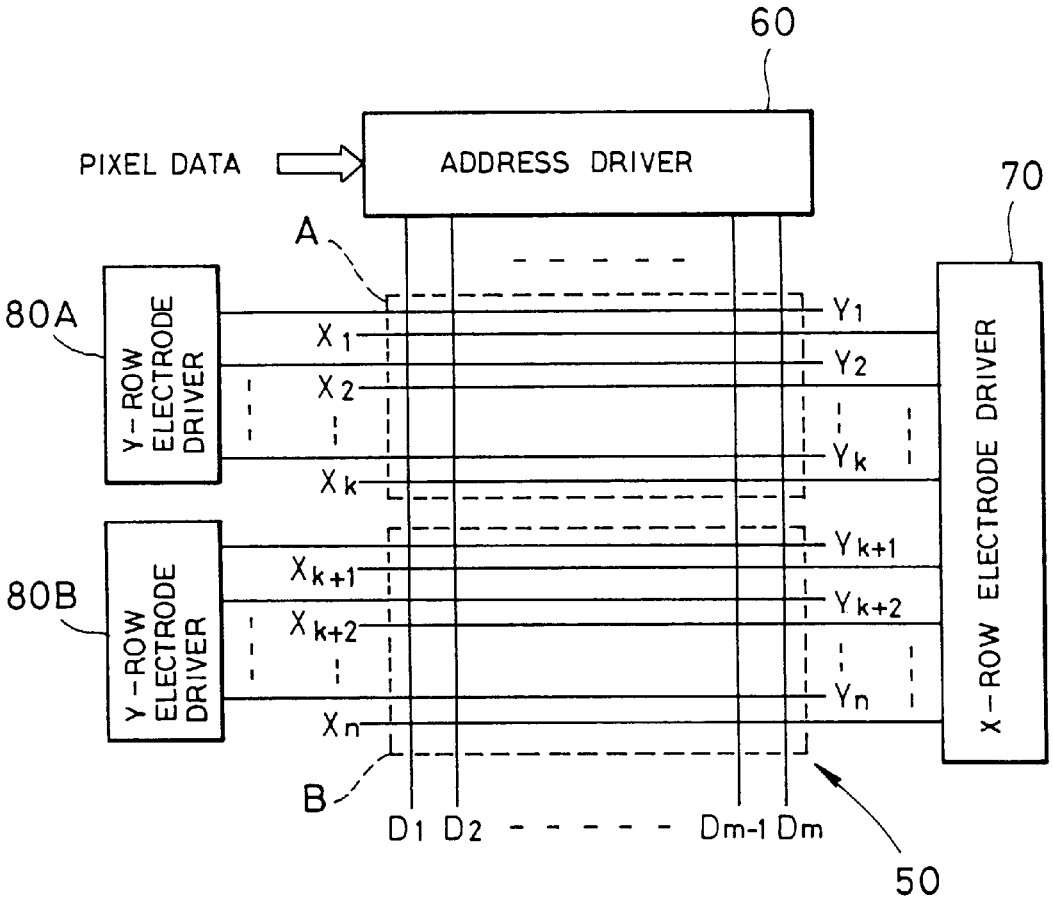
FIG. 3 is a diagram schematically showing the structure of the plasma display device driven by a driving method according to the present invention.

FIG. 3 shows the structure of a plasma display device for driving PDP by a driving method according to the present invention. FIGS. 4A–4I are timing charts of the application of various driving pulses by this driving method.

In PDP 50 shown in FIG. 3, formed are row electrodes $Y_1$ through $Y_n$ and row electrodes $X_1$ through $X_n$ which make pairs of row electrodes so that a pair of X and Y may correspond to each of rows (the first to n-th rows) on one screen. Furthermore, formed are column electrodes $D_1$ through $D_m$ which make column electrodes so that they may be perpendicular to these pairs of row electrodes, a dielectric layer and a discharge space (not shown) may be placed therebetween and they may each correspond to each of columns (the first to m-th columns) on one screen. At this time, one discharge cell is formed at an intersection of a pair of row electrodes (X, Y) and one column electrode D. In this case, one screen in the PDP 50 is divided into two upper and lower blocks A and B as shown in FIG. 3.

A Y-row electrode driver 80A is used for applying various driving pulses as described below to the row electrodes Y included in the block A, that is, the row electrodes $Y_1$ through $Y_k$. On the other hand, a Y-row electrode driver 80B is used for applying various driving pulses as described below to the row electrodes Y included in the block B, that is, the row electrodes $Y_{k+1}$ through $Y_n$. An X-row electrode driver 70 is used for applying various driving pulses as described below to the row electrodes $X_1$ through $X_n$ in the PDP 50.

Figures 4A, 4B, 4C, 4D, 4E, 4F, 4G, 4H, 4I:
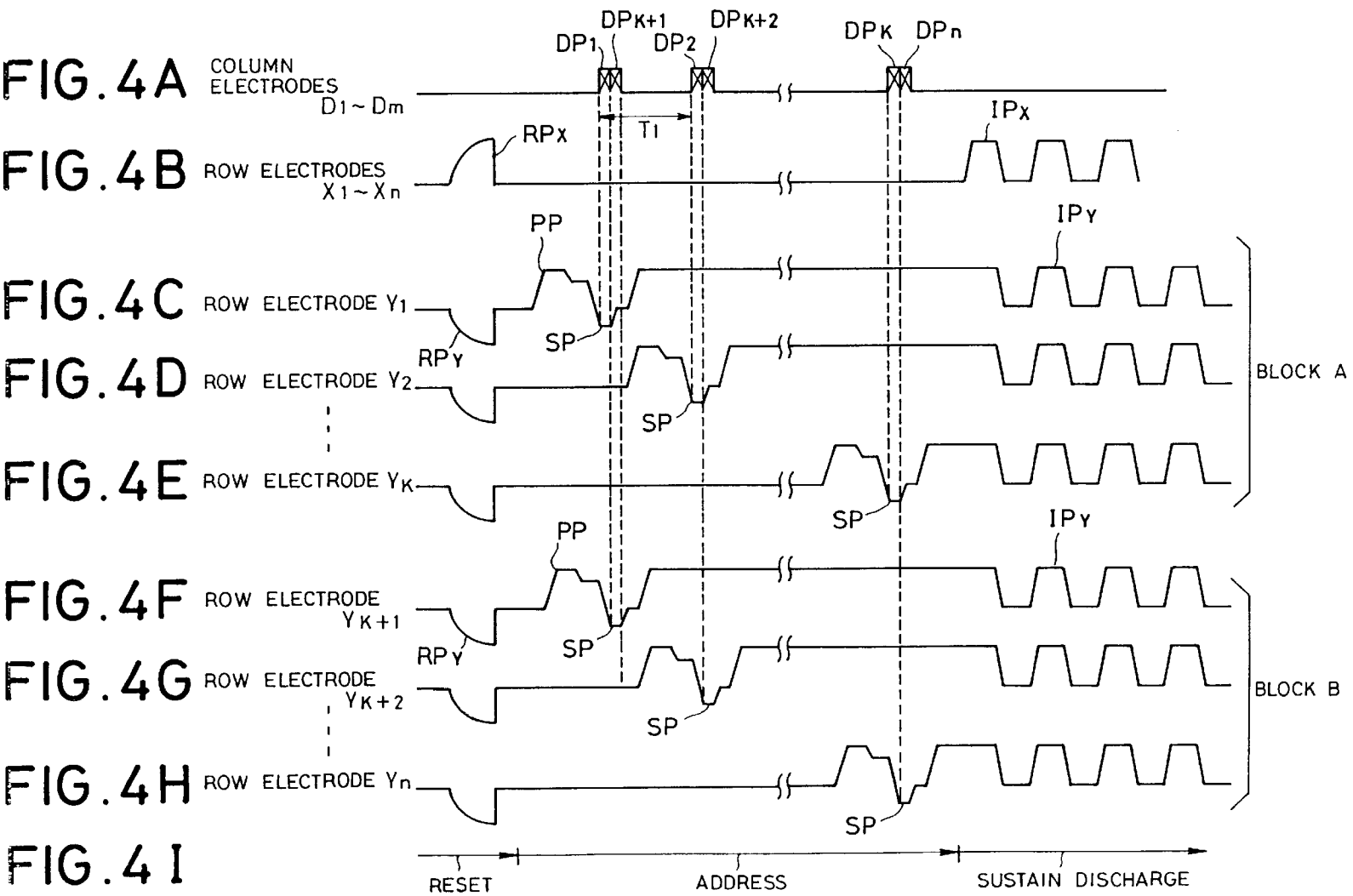
FIGS. 4A–4I are timing charts of the application of the driving pulses based on the driving method of the present invention.

In the first place, the X-row electrode driver 70 applies a positive-voltage reset pulse $RP_X$ as shown in FIG. 4B to the row electrodes $X_1$ through $X_n$ in the PDP 50 at the same time. At the same time when this reset pulse $RP_X$ is applied to the row electrodes, the Y-row electrode driver 80A applies a negative-voltage reset pulse $RP_Y$ as shown in FIGS. 4C–4E to the row electrodes $Y_1$ through $Y_k$ in the PDP 50 at the same time. Moreover, at the same time when this reset pulse $RP_X$ is applied to the row electrodes, the Y-row electrode driver 80B applies the negative-voltage reset pulse $RP_Y$ as shown in FIGS. 4F–4H to the row electrodes $Y_{k+1}$ through $Y_n$ in the PDP 50, simultaneously (a reset step).

In response to the application of these reset pulses $RP_X$ and $RP_Y$, all the discharge cells in the PDP 50 are discharged, so that charged particles are generated in the discharge spaces. After the termination of this discharge, a predetermined amount of wall charges are uniformly formed on the dielectric layers in all the discharge cells.

When this reset step is terminated, an address driver 60 converts one screen of pixel data into pixel data pulse groups DP on a row-by-row basis. Pixel data pulse groups $DP_1$ through $DP_n$ corresponding to the respective rows are then applied to the electrodes in a form as shown in FIG. 4A.

That is, the pixel data pulse groups $DP_1$ through $DP_k$ corresponding to the respective "rows" included in the block A in the PDP 50 shown in FIG. 3 are sequentially applied to the column electrodes in a cycle $T_1$ as shown in FIG. 4. In addition, the pixel data pulse groups $DP_{k+1}$ through $DP_k$ corresponding to the respective "rows" included in the block B are sequentially applied to the column electrodes in the above-described cycle $T_1$ at a delayed timing by a pulse width later than the timings of the pixel data pulse groups $DP_{k+1}$ through $DP_n$.

Here, immediately before the above-mentioned pixel data pulse group $DP_1$ is applied to the column electrode, the Y-row electrode driver 80A generates a positive-voltage priming pulse PP as shown FIG. 4C and applies this priming pulse PP to the row electrode $Y_1$. Next, the Y-row electrode driver 80A applies a negative-voltage scan pulse SP as shown FIG. 4C to the row electrode $Y_1$ at the same timing as the timing of the application of the pixel data pulse group $DP_1$.

On the other hand, immediately before the above-mentioned pixel data pulse group $DP_{k+1}$ is applied to the column electrode, the Y-row electrode driver 80B generates the positive-voltage priming pulse PP as shown FIG. 4F and applies this priming pulse PP to the row electrode $Y_{k+1}$. Next, the Y-row electrode driver 80B applies the negative-voltage scan pulse SP as shown FIG. 4F to the row electrode $Y_{k+1}$ at the same timing as the timing of the application of the pixel data pulse group $DP_{k+1}$.

On the termination of the application of the above-described scan pulse SP by the Y-row electrode driver 80B, just before the aforementioned pixel data pulse group $DP_2$ is applied to the column electrode, the Y-row electrode driver 80A generates the positive-voltage priming pulse PP as shown FIG. 4D and applies this priming pulse PP to the row electrode $Y_2$. Next, the Y-row electrode driver 80A applies the negative-voltage scan pulse SP as shown FIG. 4D to the row electrode $Y_2$ at the same timing as the timing of the application of the pixel data pulse group $DP_2$.

On the other hand, just before the above-described pixel data pulse group $DP_{k+2}$ is applied to the column electrode, the Y-row electrode driver 80B generates the positive-voltage priming pulse PP as shown FIG. 4G and applies this priming pulse PP to the row electrode $Y_{k+2}$. Next, the Y-row electrode driver 80B applies the negative-voltage scan pulse SP as shown FIG. 4G to the row electrode $Y_{k+2}$ at the same timing as the timing of the application of the pixel data pulse group $DP_{k+2}$.

At the same timing as the above-mentioned timing, the Y-row electrode driver 80A successively applies the priming pulse PP and the scan pulse SP to the row electrodes $Y_3$ through $Y_k$ in the PDP 50. Moreover, the Y-row electrode driver 80B successively applies the priming pulse PP and the scan pulse SP to the row electrodes $Y_{k+3}$ through $Y_n$ (an address step).

In the described-above address step, the discharge cells existing in the row electrodes which have been subjected to the application of the scan pulse SP are divided into two kinds in response to the pixel data pulse groups DP applied at this time. One is the discharge cells which perform discharging excitation and the other is the discharge cells which perform no discharging excitation. In this case, the wall charges remain on the dielectric layers in the discharge cells which performed no discharging excitation, while the wall charges on the dielectric layers disappear from the discharge cells which performed the discharging excitation. The lighting discharge cells and the un-lighting discharge cells are set in accordance with an amount of the wall charges, so that a so-called pixel data write is carried out.

The priming pulse PP is applied to the electrode immediately before the application of the scan pulse SP, whereby the charged particles, which have been generated in the above-described reset step and reduced with the passage of time, are reformed in the discharge space in the PDP 50. That is to say, before the charged particles are absent, the pixel data is written by the application of the above-mentioned scan pulse SP. Therefore, under the same conditions (where the amount of the charged particles within the discharge cells) on any one of the first to n-th rows, the pixel data write is carried out.

Subsequently, the X-row electrode driver 70 incessantly applies a positive-voltage sustain pulse $IP_X$ as shown in FIG. 4B to the row electrodes $X_1$ through $X_n$. The Y-row electrode drivers 80A and 80B incessantly apply a positive-voltage sustain pulse $IP_Y$ as shown in FIGS. 4C–4H to the row electrodes $Y_1$ through $Y_n$ at a timing shifted from the timing of the application of the sustain pulse $IP_X$ (a sustain discharge step).

Over the time period for which the sustain pulses $IP_X$ and $IP_Y$ are alternately applied to the row electrodes, the discharge cells which have been set to the lighting discharge cell in the above-described address step (the discharge cells in which the wall charges remain residual) are repeatedly discharged and emit a light, and the discharge cells keep emitting the light. Luminance is visually recognized in accordance with the time period for which this sustain discharge is carried out.

As described above, in the driving method shown in FIGS. 4A–4I, the timings of the application of the priming pulse PP to two different row electrodes are set so that they may be substantially the same as each other, whereby an attempt is made to reduce an address write cycle. For example, in FIGS. 4A–4I, the timing of the application of the priming pulse PP to the row electrode $Y_1$ is substantially the same as the timing of the application of the priming pulse PP to the row electrode $Y_{k+1}$, or the timing of the application of the priming pulse PP to the row electrode $Y_2$ is substantially the same as the timing of the application of the priming pulse PP to the row electrode $Y_{k+2}$.

Furthermore, as shown in FIGS. 4C–4H explained above, the row electrode Y of a pair of the row electrodes X and Y is divided into two groups A and B. Immediately after applying the scan pulse SP to the row electrode Y in the group A, the scan pulse is applied to the row electrode Y in the group B. By such a driving method, the timings of the application of the pixel data pulse groups $DP_1$ through $DP_n$ (the timings of the application of the scan pulse SP) are set in such a manner that they are not the same as the timings of the application of the priming pulse PP to any row electrode.

Thus, the address write cycle can be reduced, while an erroneous discharge caused by the simultaneous application of the pixel data pulse groups DP and the priming pulse PP can be also prevented, and therefore a high image quality can be maintained.

Also, in the above-described embodiment shown in FIG. 3, the screen in the PDP 50 is divided into two upper and lower blocks A and B, namely, the block A including the row electrodes $X_1$ through $X_k$ ($Y_1$ through $Y_k$) in the upper half and the block B including the row electrodes $X_{k+1}$ through $X_n$ ($Y_{k+1}$ through $Y_n$) in the lower half. The row electrodes in the blocks A and B are driven by the Y-row electrode drivers 80A and 80B, respectively.

Figure 5:
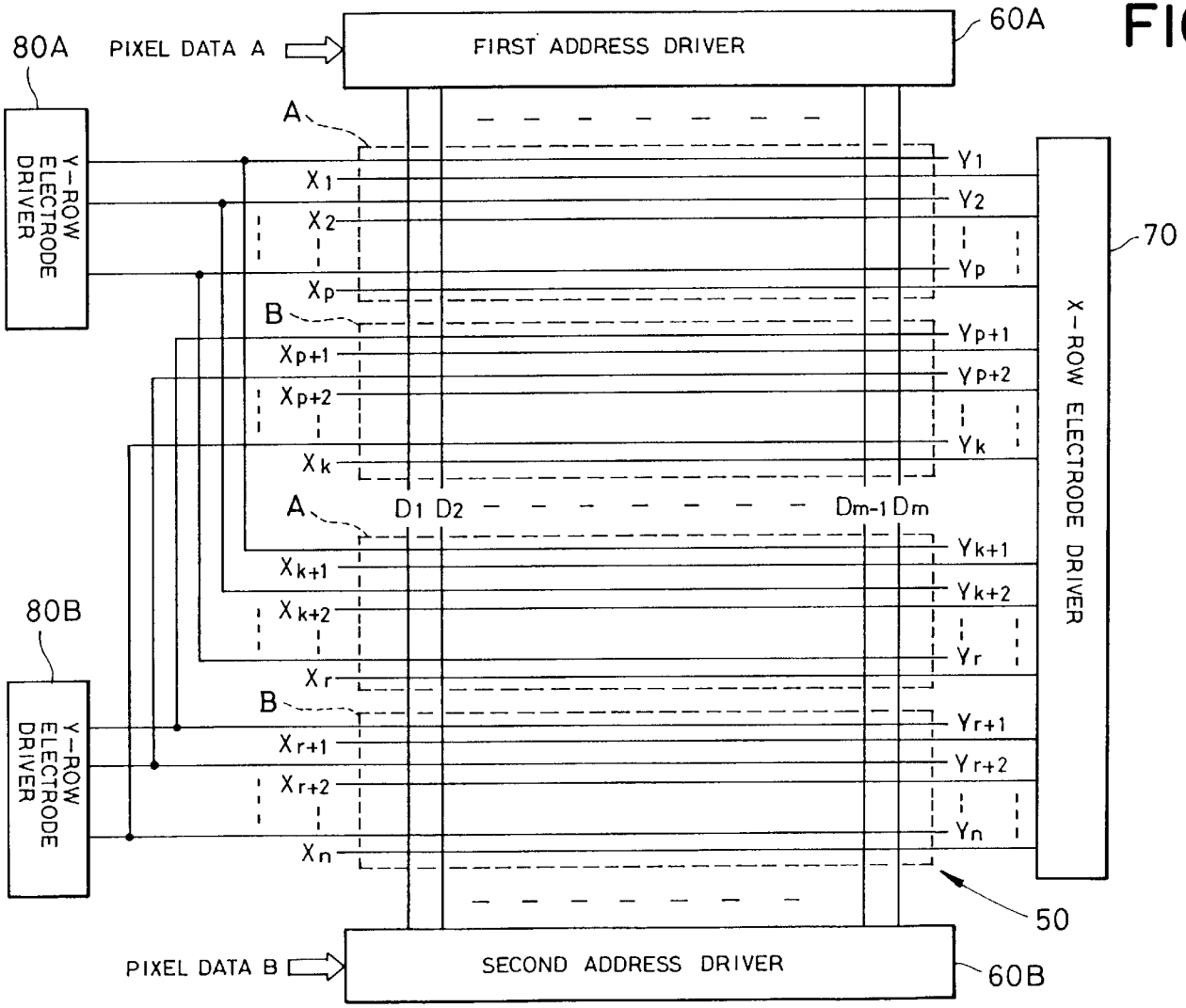
FIG. 5 is a diagram showing another embodiment of the plasma display device driven by the driving method according to the present invention.
Figures 6A, 6B, 6C, 6D, 6E, 6F, 6G, 6H, 6I:
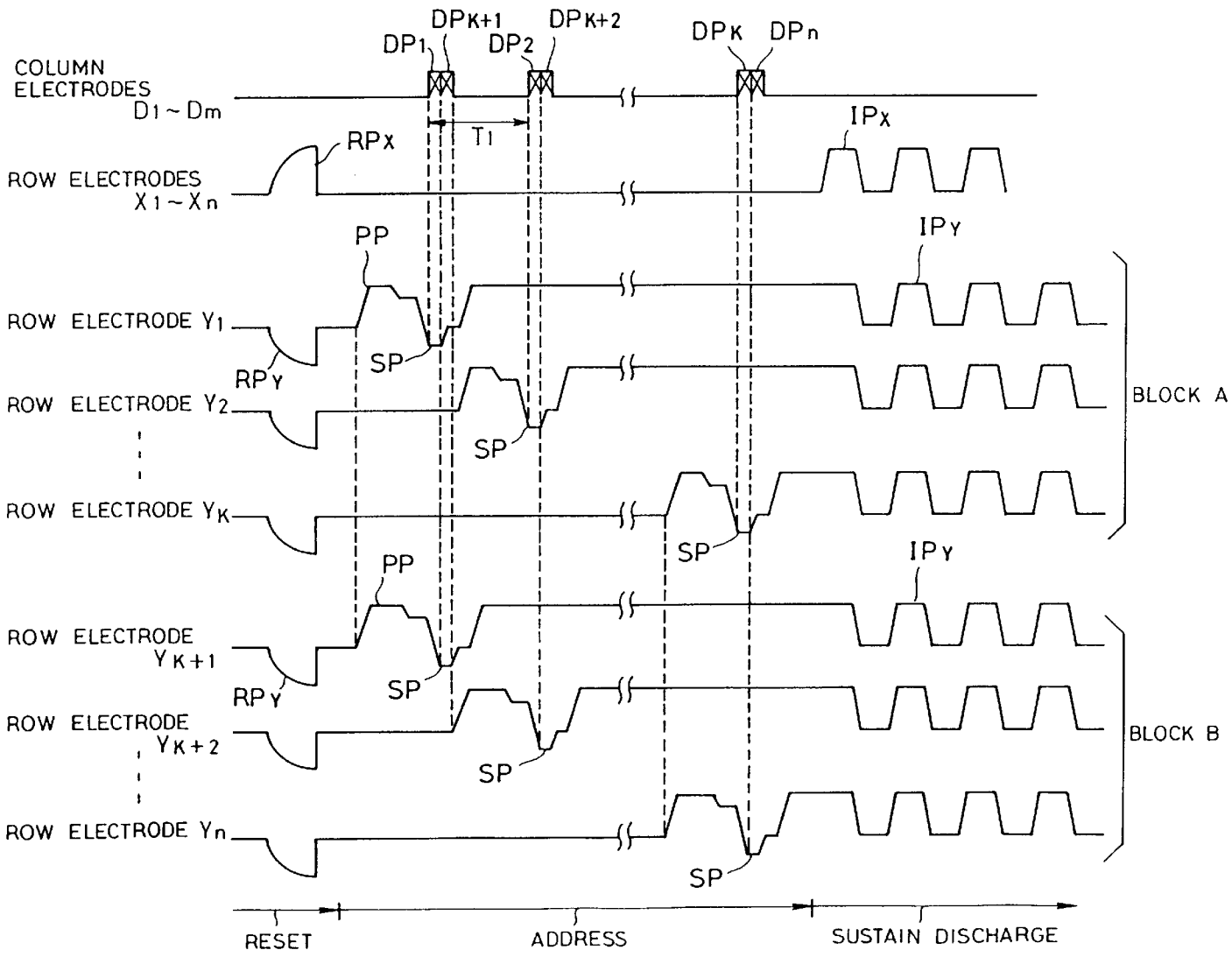
FIGS. 6A–6I are timing charts of the application of the driving pulses based on another driving method of the present invention.

However, as shown in FIG. 5, the row electrodes $X_1$ through $X_k$ ($Y_1$ through $Y_k$) in the upper half on the screen in the PDP 50 may be furthermore divided into two upper and lower blocks A and B, and the row electrodes $X_{k+1}$ through $X_n$ ($Y_{k+1}$ through $Y_n$) in the lower half may be furthermore divided into two upper and lower blocks A and B. The row electrodes in the blocks A and B may be driven by the Y-row electrode drivers 80A and 80B, respectively.

In FIG. 5, the row electrodes $X_1$ through $X_k$ ($Y_1$ through $Y_k$) in the upper half on the screen in the PDP 50 are divided into blocks A and B, namely, the block A including the row electrodes $X_1$ through $X_p$ ($Y_1$ through $Y_p$) and the block B including the row electrodes $X_{p+}1$ through $X_k$ ($Y_{p+1}$ through $Y_k$). The row electrodes $X_{k+1}$ through $X_n$ ($Y_{k+1}$ through $Y_n$) in the lower half on the screen in the PDP 50 are also divided into blocks A and B, namely. The block A includes the row electrodes $X_{k+1}$ through $X_r$ ($Y_{k+1}$ through $Y_r$), and the block B includes the row electrodes $X_{r+1}$ through $X_n$ ($Y_{r+1}$ through $Y_n$).

In this case, the Y-row electrode driver 80A drives the row electrodes $Y_1$ through $Y_p$ and the row electrodes $Y_{k+1}$ through $Y_r$, simultaneously, while the Y-row electrode driver 80B drives the row electrodes $Y_{p+1}$ through $Y_k$ and the row electrodes $Y_{r+1}$ through $Y_n$, simultaneously.

Additionally, the column electrodes $D_1$ through $D_m$ are divided into two sections, namely, the upper half (the first to k-th rows) and the lower half (the (k+1)-th to n-th rows) in the PDP 50. The upper and lower halves are driven by first and second address drivers 60A and 60B, respectively. Pixel data A supplied to the first address driver 60A corresponds to the first to k-th rows in the PDP 50, while pixel data B supplied to the second address driver 60B corresponds to the (k+1)-th to n-th rows in the PDP 50.

According to the constitution shown in FIG. 5, it will be possible to perform a simultaneous writing/scanning for the row electrode groups in the upper and lower halves in the PDP 50.

For example, in FIG. 5, the Y-row electrode driver 80A applies the scan pulse SP to the row electrodes $Y_1$ and $Y_k$ simultaneously. At this time, the pixel data pulse group $DP_1$ corresponding to the row electrode $Y_1$ is applied to the column electrodes by the first address driver 60A, while the pixel data pulse group $DP_k$ corresponding to the row electrode $Y_k$ is applied to the column electrodes by the second address driver 60B. That is to say, two rows of write is done by one scan.

Therefore, the employment of the constitution shown in FIG. 5 allows the address write cycle to be furthermore reduced to ½.

In the embodiment shown in FIGS. 4A–4I, the start timing of the application of the priming pulse PP in the block A does not precisely coincide with the start timing of the application of the priming pulse PP in the block B. However, as shown in FIGS. 6A–6I, both the timings may exactly coincide with each other by advancing the start timing of the application of the priming pulse PP in the block B.

However, due to this advancement of the start timing of the application of the priming pulse PP in the block B, the pulse width of the priming pulse PP generated by the Y-row electrode driver 80B is larger than the pulse width of the priming pulse PP generated by the Y-row electrode driver 80A.

Thus, the Y-row electrode drivers 80A and 80B become disadvantageously unbalanced at the address margins thereof.

Figure 7:
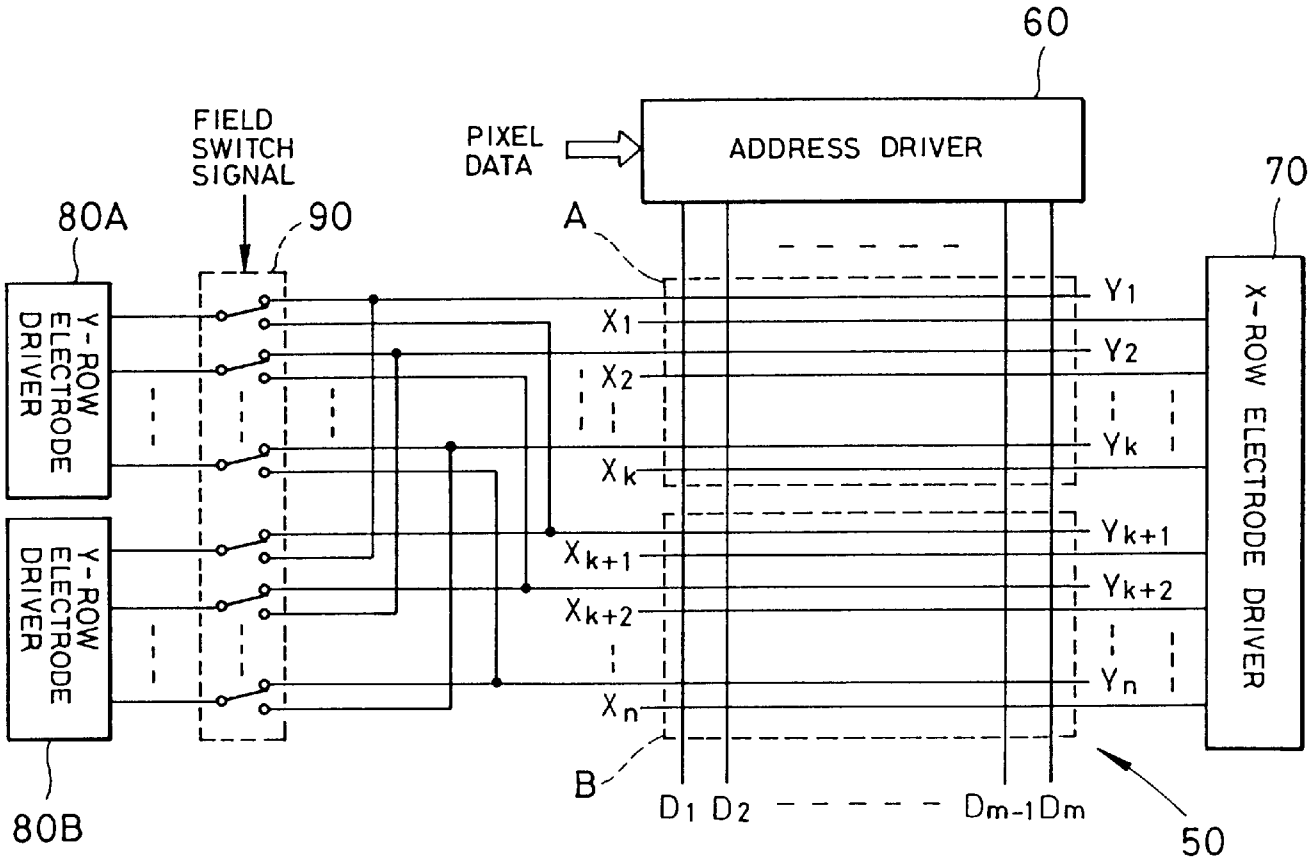
FIG. 7 is a diagram showing still another embodiment of the plasma display device driven by the driving method according to the present invention.

FIG. 7 shows the other constitution of a driving device for overcoming such a problem.

The constitution shown in FIG. 7 is the same as the constitution shown in FIG. 3 except for a selector 90. Modules having the same functions as the functions of the modules shown in FIG. 3 have the same reference numerals.

The selector 90 shown in FIG. 7 applies various driving pulses from the Y-row electrode driver 80A to the row electrodes (the row electrodes $Y_1$ through $Y_k$) in the block A or the row electrodes (the row electrodes $Y_{k+1}$ through $Y_n$) in the block B in response to a field switch signal. The selector 90 also applies various driving pulses from the Y-row electrode driver 80B to the row electrodes (the row electrodes $Y_{k+1}$ through $Y_n$) in the block B or the row electrodes (the row electrodes $Y_1$ through $Y_k$) in the block A in response to the field switch signal.

At this time, the field switch signal has its logical level which is changed from "1" to "0" or from "0" to "1", for example, for every field (sub-field) in the supplied pixel data.

For example, when the logical level of the field switch signal is "1", various driving pulses from the Y-row electrode driver 80A are applied to the row electrodes (the row electrodes $Y_1$ through $Y_k$) in the block A, and various driving pulses from the Y-row electrode driver 80B are also applied to the row electrodes (the row electrodes $Y_{k+1}$ through $Y_n$) in the block B. Here, when the logical level of the field switch signal is switched from "1" to "0", various driving pulses from the Y-row electrode driver 80A are applied to the row electrodes (the row electrodes $Y_{k+1}$ through $Y_n$) in the block B, and various driving pulses from the Y-row electrode driver 80B are applied to the row electrodes (the row electrodes $Y_1$ through $Y_k$) in the block A.

That is, in the above-mentioned constitution shown in FIG. 7, the Y-row electrode drivers 80A and 80B alternately drive the blocks A and B on the field-by-field basis (subfield-by-subfield basis).

Therefore, even if the pulse width of the priming pulse PP generated by the Y-row electrode driver 80A is different from the pulse width of the priming pulse PP generated by the Y-row electrode driver 80B, the address margin can be uniformly formed.

Figure 8:
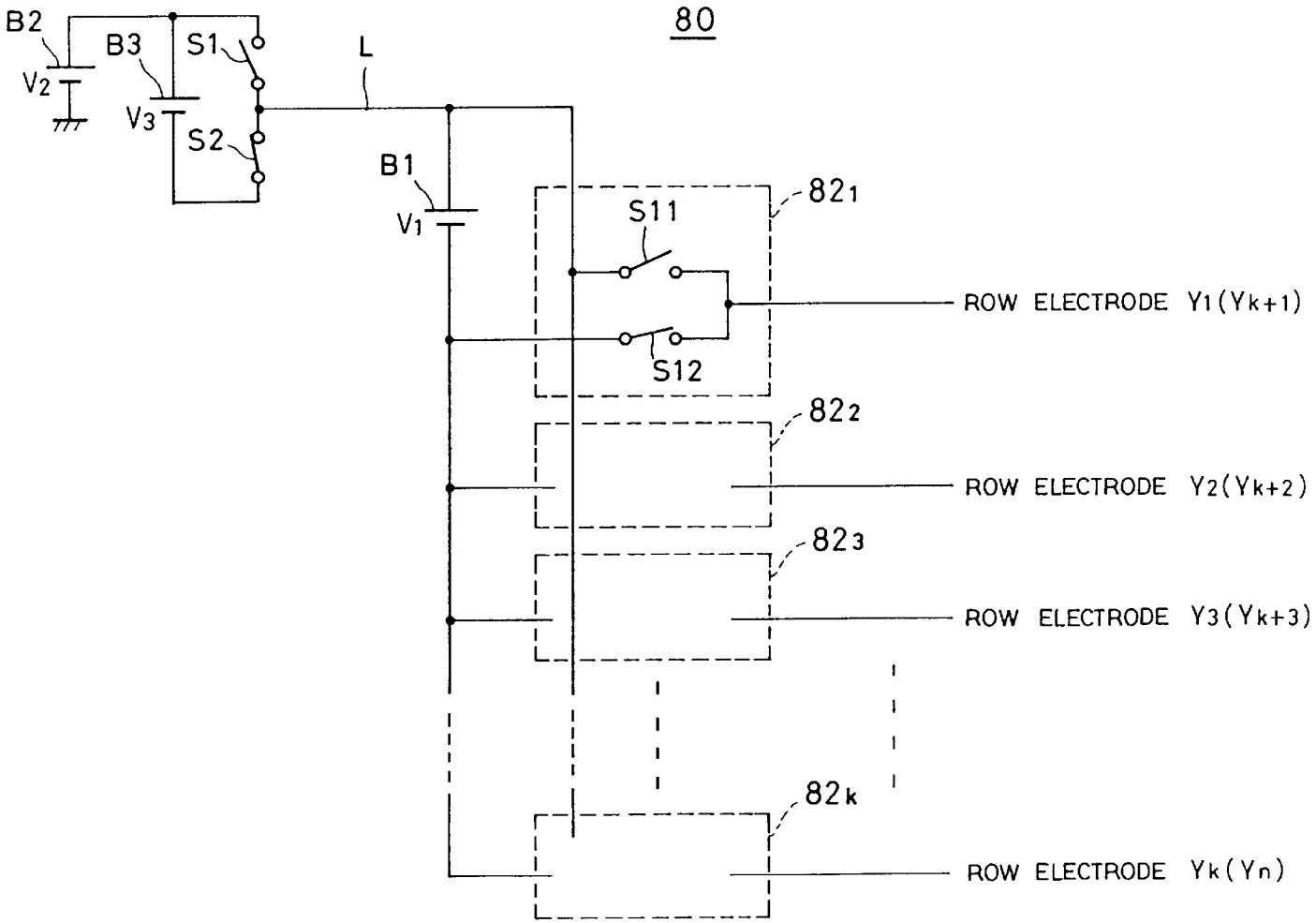
FIG. 8 is a diagram showing an internal structure of a Y-row electrode driver 80.

FIG. 8 shows a partially internal constitution (a priming pulse generator and a scan pulse generator) of the above-mentioned Y-row electrode driver 80.

As shown in FIG. 8, the aforementioned Y-row electrode driver 80 is provided with first to third power sources B1–B3 whose voltage values differ from each other. The second power source B2 generates a DC voltage $V_2$ that is, by a predetermined voltage, lower than a DC voltage $V_1$ generated by the first power source B1. The positive terminal of the third power source B3 is connected to the positive terminal of the DC power source B2. A serial circuit constituted of switching elements S1 and S2 is connected between both the terminals of the third power source B3. When the switching element S1 is turned on, the element S1 applies the potential of the positive terminal of the second power source B2 (or the positive terminal of the third power source B3) onto a line L. When the switching element S2 is turned on, the element S2 applies the potential of the negative terminal of the third power source B3 onto the line L.

The line L is connected to the positive terminal of the first power source B1 generating the DC voltage $V_1$.

Pulse output circuits $\mathbf{82}_1$ through $\mathbf{82}_k$ are composed of the same circuit constitution. Each of the circuits $\mathbf{82}_1$ through $\mathbf{82}_k$ comprises a switching element S11 for applying the potential on the line L to the row electrodes Y during the period of time when being turned on and a switching element S12 for applying the potential of the negative terminal of the first power source B1 to the row electrodes Y during being turned on.

Figure 9:
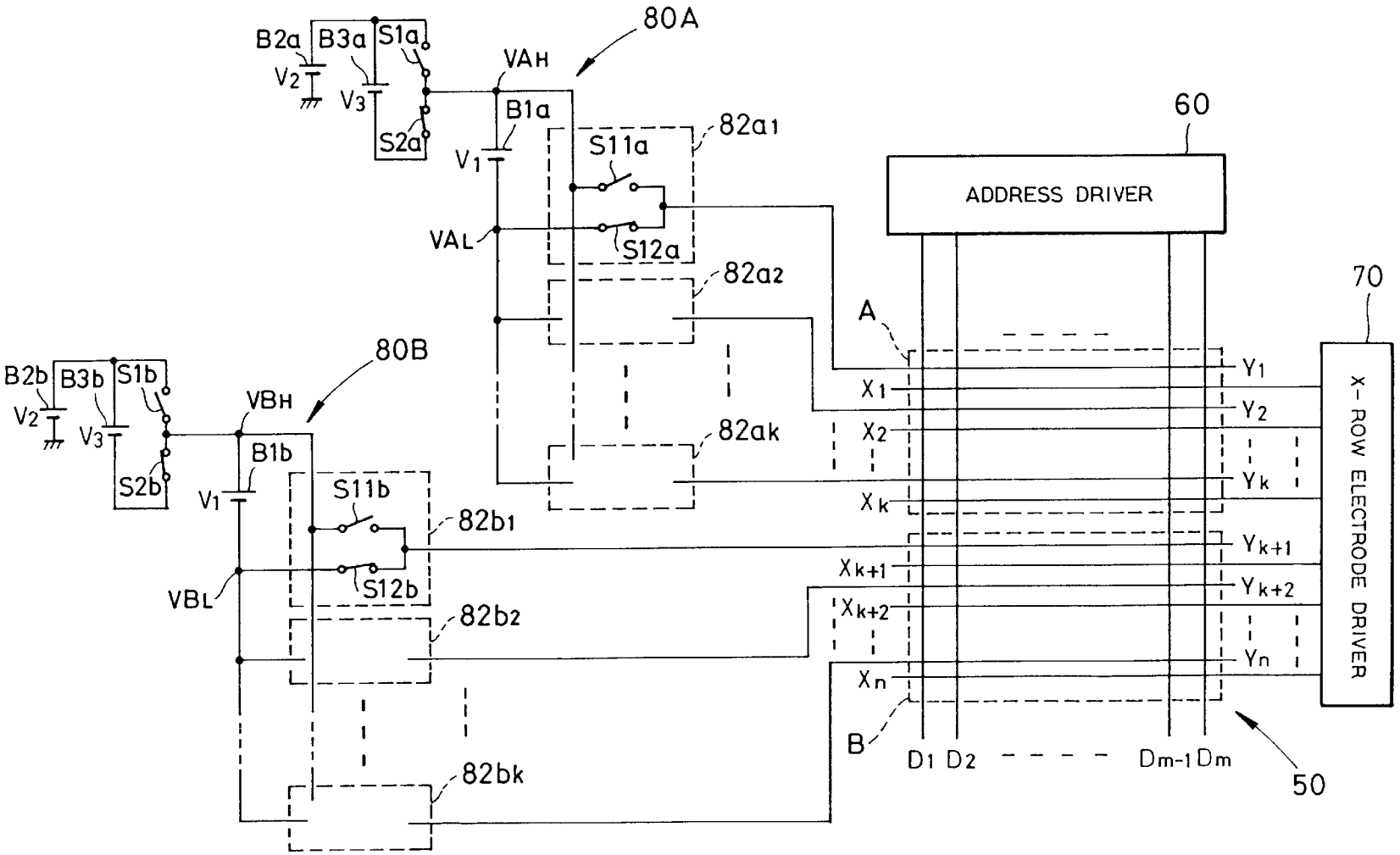
FIG. 9 is a diagram showing the constitution of the plasma display device to which the Y-row electrode driver 80 shown in FIG. 8 is applied.
Figures 10A, 10B, 10C, 10D, 10E, 10F, 10G, 10H, 10I, 10J, 10K, 10L, 10M, 10N, 10O:
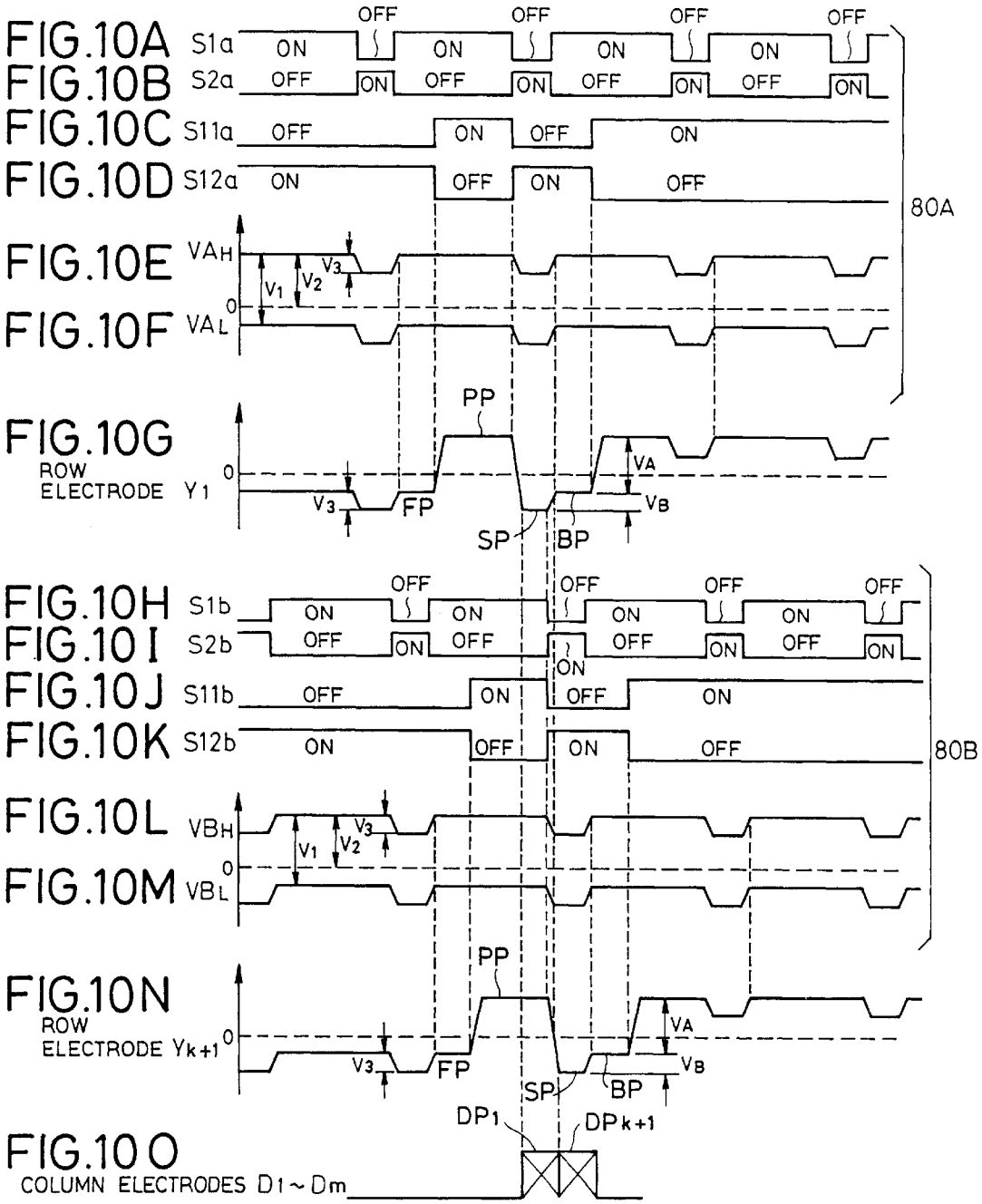
FIGS. 10A–10O show operating waveforms generated by the plasma display device shown in FIG. 9.

FIG. 9 shows the constitution of the plasma display device when the Y-row electrode driver 80 having the internal constitution shown in FIG. 8 is applied to the Y-row electrode drivers 80A and 80B of FIG. 3. FIGS. 10A–10O show operating waveforms of the plasma display device of FIG. 9.

In FIGS. 10A–10O, there is shown the operation only when the priming pulse PP and the scan pulse SP are applied to the row electrode $Y_1$ of the row electrodes in the block A and the row electrode $Y_{k+1}$ of the row electrodes in the block B.

As shown in FIGS. 10A–10O, switching elements S1*a* and S2*a* (S1*b* and S2*b*) included in the Y-row electrode driver 80 are alternately/periodically turned on/off. In his way, a positive terminal potential $VA_H$ and a negative terminal potential $VA_L$ of a first power source B1*a* (a positive terminal potential $VB_H$ and a negative terminal potential $VB_L$ of a first power source B1*b*) are each allowed to periodically form a period having the potential that is offset by a voltage value $V_3$. Here, during the time when a switching element S11*a* (S11*b*) is turned off and a switching element S12*a* (S12*b*) is turned on, the as-unchanged negative terminal potential $VA_L$ ($VB_L$) is applied onto the row electrodes Y. Next, when the switching element S11*a* (S11*b*) is switched on and the switching element S12*a* (S12*b*) is switched off, the as-unchanged positive terminal potential $VA_H$ ($VB_H$) is applied onto the row electrodes Y. This is the priming pulse PP. Subsequently, again, when the switching element 11*a* (S11*b*) is switched off and the switching element S12*a* (S12*b*) is switched on, the as-unchanged negative terminal potential $VA_L$ ($VB_L$) is applied onto the row electrodes Y. At t is time, as described above, the period having the potential that is offset by the voltage value $V_3$ is the scan pulse SP.

Also in FIGS. 10A–10O, the application of the scan pulse SP to one row electrode ($Y_1$) in the block A is followed by the application of the scan pulse SP to one row electrode ($Y_{k+1}$) in the block B. That is, an address operation (a selective address erasure) is successively executed on one line in the block A and one line in the block B.

At this time, as shown in FIGS. 10N and 10O, when the scan pulse SP is applied to the row electrode $Y_{k+1}$ in the block B and the pixel data pulse $DP_{k+1}$ is applied to the column electrodes $D_1$ through $D_m$ so as to write the pixel data, a back porch BP of the scan pulse SP is present on the row electrode $Y_1$ in the block A at the same timing as this timing. However, if a potential difference $V_a$ between the scan pulse SP and the back porch BP is small, the erroneous discharge is generated between the row electrode $Y_1$ and the column electrode due to the pixel data pulse $DP_{k+1}$. Moreover, if a potential difference $V_A$ shown in FIGS. 10G and 10N is small the erroneous priming discharge (between the row electrodes X and Y) is easily generated in a front porch FP just before the priming pulse PP.

Accordingly, in the embodiment shown in FIGS. 9 and 10A–10O, the potential of the back porch BP in the block A overlapping with the period of the application of the scan pulse in the block B is set to an intermediate potential (a third potential) between the potential of the scan pulse SP and the potential of the priming pulse PP.

Alternatively, the pulse width of the scan pulse SP in the block B may be longer than the priming pulse PP in the block A by eliminating the back porch BP just after the scan pulse SP in the block B.

FIGS. 11A–11O show the other operating wave forms of the plasma display device made in view of this point.

In FIGS. 11A–11O, in the first place, the timing at which the switching element S11*b* (S12*b*) included in the Y-row electrode driver 80B is switched from OFF to ON (from ON to OFF) is made equal to the switch timing of the switching elements S11*a* and S12*a* of the Y-row electrode driver 80A. After that, only during the period when the positive and negative terminal potentials $VB_H$ and $VB_L$ of the first power source B1*b* included in the Y-row electrode driver 80B are offset by the voltage value $V_3$, the switching element S11*b* (S12*b*) is turned off (on). Thus, as shown in FIG. 11N, not only the back porch BP just after the application of the scan pulse but also the front porch FP just before the priming pulse PP are eliminated from the row electrode $Y_{k+1}$.

As shown in FIGS. 11G and 11N, when the block A is driven by the Y-row electrode driver 80A, the back porch BP is present just after the scan pulse SP. On the other hand, when the block B is driven by the Y-row electrode driver 80B, the back porch BP and the front porch FP are eliminated. Thus, the pulse width of the priming pulse PP in the block B can be increased, and consequently the address margin in the block B is increased.

In the embodiment shown in FIGS. 9 and 11A–11O, the potentials of the back porch BP and the front porch FP existing during driving the block A are determined by the potential of the negative terminal of the first power source B1. Therefore, since the potentials of these back porch BP and front porch FP cannot be thoughtlessly adjusted, it is not easy to take measures to prevent the erroneous discharge.

Figure 12:
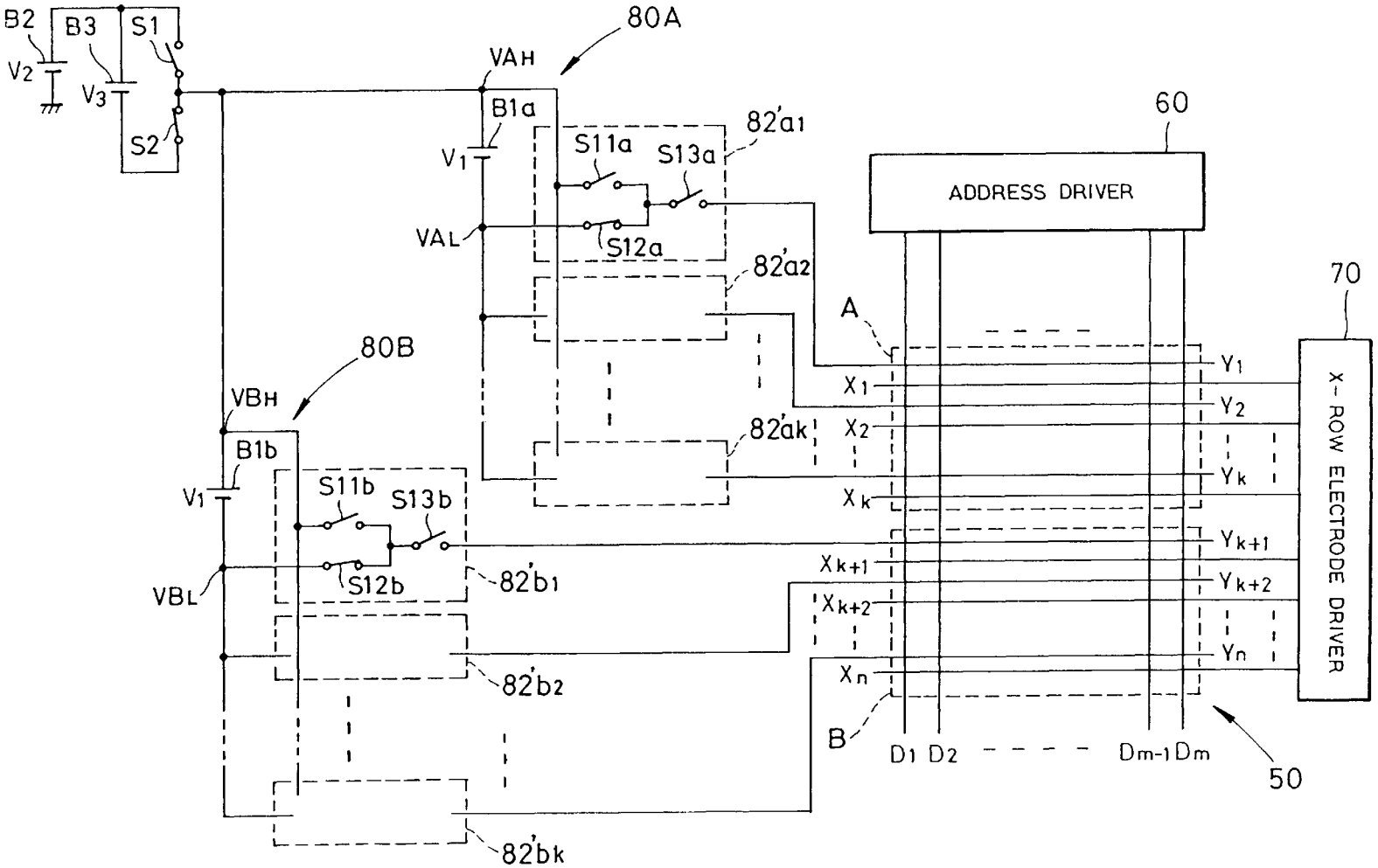
FIG. 12 is a diagram showing another exemplary structure of the plasma display device shown in FIG. 9.

FIG. 12 shows another constitution of the plasma display device made in view of this point.

In the plasma display device shown in FIG. 12, a circuit comprising a second power source B2*a* (B2*b*), a third power source B3*a* (B3*b*) and switching elements S1*a* (S1*b*) and S2*a* (S2*b*) is shared by the Y-row electrode drivers 80A and 80B, although such a circuit is disposed in each of the Y-row electrode drivers 80A and 80B in the constitution shown in FIG. 9. Furthermore, pulse output circuits 82' (if FIG. 12 are constituted so that an output from the switching element S11*a* (S11*b*) or S12*a* (S12*b*) is applied to the row electrodes Y through a switching element S13*a* (S13*b*). In short, during the period when the switching element S13 is turned off, the application of the voltage to the row electrodes Y is forced to be stopped.

FIGS. 13A–13M show the operating waveforms generated by the plasma display device shown in FIG. 12.

Figures 13A, 13B, 13C, 13D, 13E, 13F, 13G, 13H, 13I, 13J, 13K, 13L, 13M:
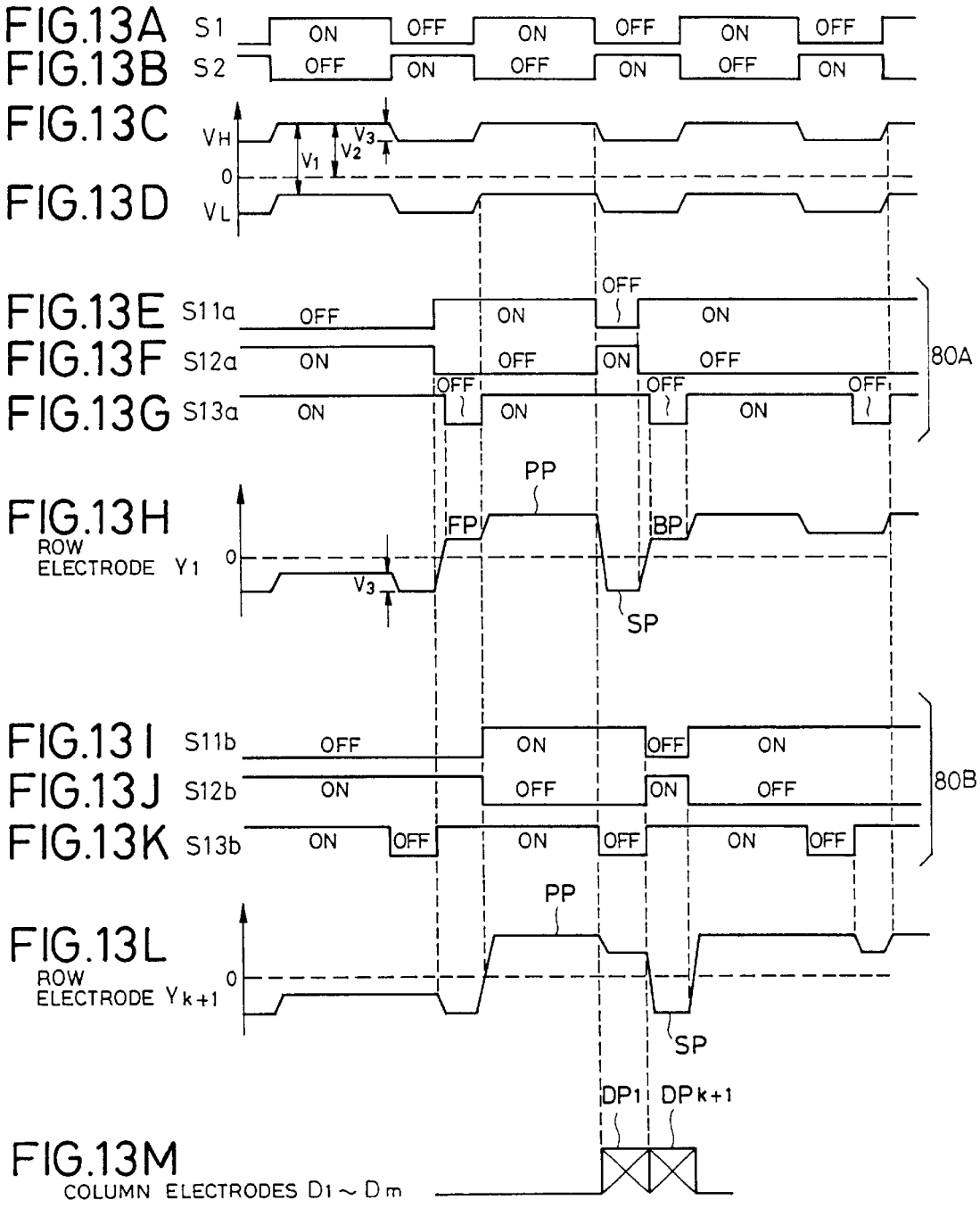
FIGS. 13A–13M are diagrams showing still another example of the operating waveforms generated by the plasma display device shown in FIG. 12.

As shown in FIG. 13G, the switching element S13*a* is switched from ON to OFF during driving the block A, whereby the application of the voltage from the Y-row electrode driver 80A is stopped. At this time, since the PDP 50 is capacitively loaded, the potential just after switching is fixedly left on the row electrodes Y. As shown in FIG. 13H, this potential is changed into the back porch BP or the front porch FP. That is, the potentials of the back porch BP just before the priming pulse PP and the front porch FP just after the scan pulse SP are set in accordance with the timing of the switching from ON to OFF by the switching element S13*a*. Therefore, this timing is adjusted, whereby the potentials of the back porch BP and the front porch FP can be set so that they may be within a range in which the erroneous discharge is not generated between the row electrodes or between the row and column electrodes.

The increase of the address margin is therefore facilitated, and thus the image quality and the panel yield can be improved. Moreover, although the second and third power sources B2 and B3 are disposed in each of the Y-row electrode drivers 80A and 80B in FIG. 9, they are shared by the Y-row electrode drivers 80A and 80B as shown in FIG. 12. Thus, the circuit scale can be reduced in comparison to the constitution shown in FIG. 9.

Although the above-described embodiments show that one screen in the PDP 50 is divided into two upper and lower blocks and one of a pair of row electrodes is divided into two row electrode groups so as to drive the electrodes, the present invention is not limited to this example. The electrodes may be driven by dividing one screen into two sections, an odd line and an even line and by dividing one of a pair of row electrodes into three or four row electrode groups.

Although the preferred embodiments of the present invention have been described in detail, it should be understood that various changes, substitutions and alternations can be made therein without departing from spirit and scope of the inventions as defined by the appended claims.

What is claimed is:

1. A method of driving a plasma display panel which has a plurality of pairs of row electrodes and a plurality of column electrodes, said plurality of column electrodes being arranged so as to cross said pairs of row electrodes and forming discharge cells at intersections of said pairs of row electrodes and said column electrodes, said method performing, when driving said plasma display panel to emit light, an operation of dividing one field of display period into a plurality of subfields, each subfield being composed of an address period and a sustain discharge period so as to display an image, said address period in which, immediately after applying a priming pulse of a predetermined polarity to one of said pair of row electrodes, a scan pulse of an opposite polarity to the polarity of said priming pulse is applied to said row electrode and simultaneously a pixel data pulse is applied to said column electrode whereby lighting discharge cells and un-lighting discharge cells are set in response to said pixel data pulse, said sustain discharge period for holding said lighting discharge cells and said un-lighting discharge cells discharged by applying a sustain pulse to said pair of row electrodes, wherein ones of said pairs of row electrodes are divided into first and second row electrode groups and said scan pulse is applied to one row electrode of said second row electrode group immediately after applying said scan pulse to one row electrode of said first row electrode group, and wherein an overlap only partially exists between a period of application of a priming pulse to a row electrode of said first electrode group immediately before a scanning pulse and a period of application of a priming pulse to a row electrode of said second electrode group immediately before a scanning pulse.

2. The method according to claim 1, wherein a first priming pulse and a second priming pulse having pulse width larger than the pulse width of said first priming pulse are generated as said priming pulse, and said first and second priming pulses are alternately applied to said first and second row electrode groups on the field-by-field basis or on the subfield-by-subfield basis.

3. The method according to claim 1, wherein a reset period for forming wall charges in all of said discharge cells prior to said address period is provided, and the wall charges formed in said reset period are selectively erased in response to said scan pulse and said pixel data pulse in said address period whereby said lighting discharge cells and said un-lighting discharge cells are set.

4. The method according to claim 1, wherein each of said column electrodes is divided into two parts: an upper half and a lower half on said plasma display panel.

5. The method according to claim 1, wherein the application of said scan pulse is forced to be stopped during the rise period of said scan pulse applied to one row electrode in said first row electrode group, whereby a back porch having a potential responding to the timing of the stop of the application of said scan pulse is formed just after said scan pulse.

6. The method according to claim 1, wherein the application of said priming pulse is forced to be stopped during the rise period of said priming pulse applied to one row electrode in said first row electrode group, whereby a front porch having a potential responding to the timing of the stop of the application of said priming pulse is formed just before said priming pulse.

7. A method of driving a plasma display panel as claimed in claim 1, wherein, after an application of a scanning pulse to a row electrode of said second electrode group, a priming pulse is applied to a row electrode of said first electrode group in a row which is to be scanned next.

8. A method of driving a plasma display panel which has a plurality of pairs of row electrodes and a plurality of column electrodes, said plurality of column electrodes being arranged so as to cross said pairs of row electrodes and forming discharge cells at intersections of said pairs of row electrodes and said column electrodes, said method performing, when driving said plasma display panel to emit light, an operation of dividing one field of display period into a plurality of subfields, each subfield being composed of an address period and a sustain discharge period so as to display an image, said address period in which, immediately after applying a priming pulse of a predetermined polarity to one of said pair of row electrodes, a scan pulse of an opposite polarity to the polarity of said priming pulse is applied to said row electrode and simultaneously a pixel data pulse is applied to said column electrode whereby lighting discharge cells and un-lighting discharge calls are set in response to said pixel data pulse, said sustain discharge period for holding said lighting discharge cells and said un-lighting discharge cells discharged by applying a sustain pulse to said pair of row electrodes, wherein ones of said pairs of row electrodes are divided into first and second row electrode groups, first and second priming pulses whose waveforms differ from each other are generated as said priming pulse, and said first and second priming pulses are alternately applied to said first and second row electrode groups on the field-by-field basis or on the subfield-by-subfield basis, and wherein an overlap exists between a period of application of a priming pulse to a row electrode of said first electrode group immediately before a scanning pulse and a period of application of a priming pulse to a row electrode of said second electrode group immediately before a scanning pulse.

9. The method according to claim 8, wherein the pulse width of said second priming pulse is larger than the pulse width of said first priming pulse.

10. The method according to claim 8, wherein said scan pulse is applied to one row electrode in said second row electrode group immediately after said scan pulse is applied to one row electrode in said first row electrode group.

11. The method according to claim 8, wherein the application of said scan pulse is forced to be stopped during the rise period of said scan pulse applied to one row electrode in said first row electrode group, whereby the back porch having the potential responding to the timing of the stop of the application of said scan pulse is formed just after said scan pulse.

12. The method according to claim 8, wherein the application of said priming pulse is forced to be stopped during the rise period of said priming pulse applied to one row electrode in said first row electrode group, whereby the front porch having the potential responding to the timing of the stop of the application of said priming pulse is formed just before said priming pulse.

13. A method of driving a plasma display panel as claimed in claim 8, wherein, after an application of a scanning pulse to a row electrode of said second electrode group, a priming pulse is applied to a row electrode of said first electrode group in a row which is to be scanned next.

14. A method of driving a plasma display panel which has plurality of pairs of row electrodes and a plurality of column electrodes, said plurality of column electrodes being arranged so as to cross said pairs of row electrodes and forming discharge cells at intersections of said pairs of row electrodes and said column electrodes, said method performing, when driving said plasma display panel to emit light, an operation of dividing one field of display period into a plurality of subfields, each subfield being composed of an address period and a sustain discharge period so as to display an image, said address period in which, immediately after applying a priming pulse of a predetermined polarity to one of said pair of row electrodes, a scan pulse of an opposite polarity to the polarity of said priming pulse is applied to said row electrode and simultaneously a pixel data pulse is applied to said column electrode whereby lighting discharge cells and un-lighting discharge cells are set in response to said pixel data pulse, said sustain discharge period for holding said lighting discharge cells and said un-lighting discharge cells discharged by applying a sustain pulse to said pair of row electrodes, wherein ones of said pairs of row electrodes are divided into first and second row electrode groups and said scan pulse is applied to one row electrode of said second row electrode group immediately after applying said scan pulse to one row electrode of said first row electrode group, and wherein the application of said scan pulse is forced to be stopped during the rise period of said scan pulse applied to one row electrode in said first row electrode group, whereby a back porch having a potential responding to the timing of the stop of the application of said scan pulse is formed just after said scan pulse.

15. A method of driving a plasma display panel which has a plurality of pairs of row electrodes and a plurality of column electrodes, said plurality of column electrodes being arranged so as to cross said pairs of row electrodes and forming discharge cells at intersections of said pairs of row electrodes and said column electrodes, said method performing, when driving said plasma display panel to emit light, an operation of dividing one field of display period into a plurality of subfields, each subfield being composed of an address period and a sustain discharge period so as to display an image, said address period in which, immediately after applying a priming pulse of a predetermined polarity to one of said pair of row electrodes, a scan pulse of an opposite polarity to the polarity of said priming pulse is applied to said row electrode and simultaneously a pixel data pulse is applied to said column electrode whereby lighting discharge cells and un-lighting discharge cells are set in response to said pixel data pulse, said sustain discharge period for holding said lighting discharge cells and said un-lighting discharge cells discharged by applying a sustain pulse to said pair of row electrodes, wherein ones of said pairs of row electrodes are divided into first and second row electrode groups and said scan pulse is applied to one row electrode of said second row electrode group immediately after applying said scan pulse to one row electrode of said first row electrode group, and wherein the application of said priming pulse is forced to be stopped during the rise period of said priming pulse applied to one row electrode in said first row electrode group, whereby a front porch having a potential responding to the timing of the stop of the application of said priming pulse is formed just before said priming pulse.

16. A method of driving a plasma display panel which has a plurality of pairs of row electrodes and a plurality of column electrodes, said plurality of column electrodes being arranged so as to cross said pairs of row electrodes and forming discharge cells at intersections of said pairs of row electrodes and said column electrodes, said method performing, when driving said plasma display panel to emit light, an operation of dividing one field of display period into a plurality of subfields, each subfield being composed of an address period and a sustain discharge period so as to display an image, said address period in which, immediately after applying a priming pulse of a predetermined polarity to one of said pair of row electrodes, a scan pulse of an opposite polarity to the polarity of said priming pulse is applied to said row electrode and simultaneously a pixel data pulse is applied to said column electrode whereby lighting discharge cells and un-lighting discharge calls are set in response to said pixel data pulse, said sustain discharge period for holding said lighting discharge cell and said un-lighting discharge cells discharged by applying a sustain pulse to said pair of row electrodes, wherein ones of said pairs of row electrodes are divided into first and second row electrode groups, first and second priming pulses whose waveforms differ from each other are generated as said priming pulse, and said first and second priming pulses are alternately applied to said first and second row electrode groups on the field-by-field basis or on the subfield-by-subfield basis, and wherein the application of said scan pulse is forced to be stopped during the rise period of said scan pulse applied to one row electrode in said first row electrode group, whereby a back porch having a potential responding to the timing of the stop of the application of said scan pulse is formed just after said scan pulse.

17. A method of driving a plasma display panel which has a plurality of pairs of row electrodes and a plurality of column electrodes, said plurality of column electrodes being arranged so as to cross said pairs of row electrodes and forming discharge cells at intersections of said pairs of row electrodes and said column electrodes, said method performing, when driving said plasma display panel to emit light, an operation of dividing one field of display period into a plurality of subfields, each subfield being composed of an address period and a sustain discharge period so as to display an image, said address period in which, immediately after applying a priming pulse of a predetermined polarity to one of said pair of row electrodes, a scan pulse of an opposite polarity to the polarity of said priming pulse is applied to said row electrode and simultaneously a pixel data pulse is applied to said column electrode whereby lighting discharge cells and un-lighting discharge calls are set in response to said pixel data pulse, said sustain discharge period for holding said lighting discharge cell and said un-lighting discharge cells discharged by applying a sustain pulse to said pair of row electrodes, wherein ones of said pairs of row electrodes are divided into first and second row electrode groups, first and second priming pulses whose waveforms differ from each other are generated as said priming pulse, and said first and second priming pulses are alternately applied to said first and second row electrode groups on the field-by-field basis or on the subfield-by-subfield basis, and wherein the application of said priming pulse is forced to be stopped during the rise period of said priming pulse applied to one row electrode in said first row electrode group, whereby a front porch having a potential responding to the timing of the stop of the application of said priming pulse is formed just before said priming pulse.

* * * * *